US009303451B2

(12) United States Patent
Prince et al.

(10) Patent No.: US 9,303,451 B2
(45) Date of Patent: Apr. 5, 2016

(54) SYSTEM FOR PIVOTING A BLIND SLAT

(71) Applicants: Kendall W. Prince, Mesa, AZ (US); Aaron B. Dorny, Gilbert, AZ (US); Don A. Patterson, Gilbert, AZ (US)

(72) Inventors: Kendall W. Prince, Mesa, AZ (US); Aaron B. Dorny, Gilbert, AZ (US); Don A. Patterson, Gilbert, AZ (US)

(73) Assignee: PRECISION COATING INNOVATIONS, LLC, Gilbert, AZ (US)

( * ) Notice: Subject to any disclaimer, the term of this patent is extended or adjusted under 35 U.S.C. 154(b) by 0 days.

(21) Appl. No.: 14/012,984

(22) Filed: Aug. 28, 2013

(65) Prior Publication Data

US 2014/0238623 A1 Aug. 28, 2014

Related U.S. Application Data

(60) Provisional application No. 61/768,957, filed on Feb. 25, 2013.

(51) Int. Cl.
*E06B 9/32* (2006.01)
*E06B 9/307* (2006.01)

(52) U.S. Cl.
CPC .. *E06B 9/32* (2013.01); *E06B 9/307* (2013.01)

(58) Field of Classification Search
USPC .... 160/176.1 R, 177 R, 168.1 R, 174 R, 115, 160/114, 173 R
IPC ..... E06B 9/303,9/322, 2009/32, 2009/322, E06B 2009/3227, 9/32
See application file for complete search history.

(56) References Cited

U.S. PATENT DOCUMENTS 1,639,474 A 8/1927 Whitmore
1,807,061 A 5/1931 Dunn
2,017,541 A * 10/1935 Kuyper ..... 160/176.1 R
2,064,443 A * 12/1936 Moore ..... 160/173 R
2,068,977 A 1/1937 Dodge
2,072,835 A 3/1937 Dodge
2,090,145 A 8/1937 Pierce
2,091,012 A 8/1937 Pratt
2,111,979 A 3/1938 Lawson et al.
2,122,224 A * 6/1938 Wade et al. ..... 160/177 R (Continued)

FOREIGN PATENT DOCUMENTS

EP 2284351 A1 2/2011
JP 07040989 U 7/1995

(Continued)

OTHER PUBLICATIONS

Eaves, "Polymer Foams: Trends in Use and Technology", Rapra Technology Limited, as accessed on Apr. 12, 2011, p. 1, http://books.google.com/books?id=B9HtOnU0DzMC&printsec=frontcover&dq=Polymer+Foams:+Trends+in+Use+and+Technology&h1=en&ei=ObekTaiHEpGasAPfirH6DA&sa=X&oi=bookresult&ct=result&resnum=1&ved=0CDkQ6AEwAA#v=onepage&q&f=false.

(Continued)

*Primary Examiner* — David Purol
(74) *Attorney, Agent, or Firm* — David B. Tingey; Bryant J. Keller; Kirton McConkie

(57) ABSTRACT

Systems and methods for pivoting a blind slat by manipulating one or more tilt cords of a set of blind slats to achieve superior blind closure. More particularly, the present invention relates to a window covering having a blind slat that is rotated clockwise or counter-clockwise by rotating a driving mechanism that is positioned in a horizontal orientation. The present invention further relates to a window covering system that achieves tilting of blind slats without requiring the traditional tilting components of standard Venetian-type blinds.

20 Claims, 10 Drawing Sheets

(56) References Cited

U.S. PATENT DOCUMENTS

| | | | | | |
|---|---|---|---|---|---|
| 2,142,629 | A | | 1/1939 | Clark, Jr. | |
| 2,156,163 | A | | 4/1939 | Pierce | |
| 2,200,349 | A | * | 5/1940 | Walker | 160/173 R |
| 2,276,898 | A | * | 3/1942 | Walker | 160/34 |
| 2,543,097 | A | * | 2/1951 | Drefke | 160/168.1 R |
| 2,582,301 | A | * | 1/1952 | Walker | 160/174 R |
| 2,687,770 | A | * | 8/1954 | Walker et al. | 160/176.1 R |
| 2,748,852 | A | | 6/1956 | Akerstrom | |
| 2,754,898 | A | * | 7/1956 | Walker | 160/34 |
| 2,759,535 | A | * | 8/1956 | Berglind | 160/168.1 R |
| 2,877,487 | A | | 3/1959 | Haislip | |
| 3,682,816 | A | | 8/1972 | Yovanovich | |
| 3,795,266 | A | * | 3/1974 | Debs | 160/168.1 R |
| 3,857,914 | A | | 12/1974 | Aishima et al. | |
| 4,107,247 | A | | 8/1978 | Dukess | |
| 4,173,247 | A | | 11/1979 | Piana | |
| 4,276,954 | A | | 7/1981 | Romano | |
| 4,333,510 | A | | 6/1982 | Fox | |
| 4,343,340 | A | | 8/1982 | Paule | |
| 4,462,778 | A | | 7/1984 | Calcagni | |
| 4,643,238 | A | * | 2/1987 | Tachikawa et al. | 160/168.1 R |
| 4,719,955 | A | | 1/1988 | Tachikawa et al. | |
| 4,818,590 | A | | 4/1989 | Prince et al. | |
| 4,884,616 | A | | 12/1989 | Setele | |
| 4,889,669 | A | | 12/1989 | Suzuki | |
| 4,942,084 | A | | 7/1990 | Prince | |
| 4,947,921 | A | | 8/1990 | Chun-Cheng | |
| 5,029,413 | A | | 7/1991 | Jovanovic | |
| 5,102,598 | A | | 4/1992 | Chen | |
| 5,121,785 | A | | 6/1992 | Ohsumi | |
| 5,123,472 | A | | 6/1992 | Nagashima et al. | |
| 5,141,042 | A | | 8/1992 | Schwaegerle | |
| 5,209,282 | A | | 5/1993 | Franco et al. | |
| 5,303,507 | A | | 4/1994 | Oille | |
| 5,343,924 | A | | 9/1994 | Hoffman | |
| 5,368,458 | A | | 11/1994 | Addeo et al. | |
| 5,379,551 | A | | 1/1995 | Swapp | |
| D355,093 | S | | 2/1995 | Morris | |
| 5,474,118 | A | | 12/1995 | Hoffman | |
| 5,496,630 | A | | 3/1996 | Hawrylko et al. | |
| 5,515,902 | A | | 5/1996 | Hoffman | |
| 5,533,560 | A | | 7/1996 | Morris | |
| D372,828 | S | | 8/1996 | Sticker | |
| 5,597,027 | A | * | 1/1997 | Simon et al. | 160/168.1 R |
| 5,655,589 | A | | 8/1997 | Vartanian | |
| D385,449 | S | | 10/1997 | Morris | |
| 5,778,956 | A | | 7/1998 | Judkins | |
| 5,797,442 | A | | 8/1998 | Colson et al. | |
| 5,807,514 | A | | 9/1998 | Grinshpun et al. | |
| 5,845,691 | A | * | 12/1998 | Gaines | 160/115 |
| 5,883,143 | A | | 3/1999 | Eiben et al. | |
| D409,869 | S | | 5/1999 | Marusak | |
| 5,934,351 | A | | 8/1999 | Bharucha et al. | |
| 5,941,021 | A | | 8/1999 | Valls, Jr. et al. | |
| 5,945,048 | A | | 8/1999 | Ensinger | |
| D413,475 | S | | 9/1999 | Swapp | |
| 6,006,816 | A | | 12/1999 | Biro et al. | |
| 6,041,847 | A | | 3/2000 | Lai | |
| 6,083,601 | A | | 7/2000 | Prince et al. | |
| 6,105,657 | A | | 8/2000 | Zorbas | |
| 6,192,964 | B1 | | 2/2001 | Cianci et al. | |
| 6,226,922 | B1 | | 5/2001 | Swapp | |
| 6,296,037 | B1 | | 10/2001 | Ruggles | |
| 6,302,181 | B1 | | 10/2001 | Rupel | |
| 6,394,170 | B1 | * | 5/2002 | Hsu | 160/168.1 R |
| 6,499,264 | B2 | | 12/2002 | Swapp | |
| 6,505,667 | B2 | | 1/2003 | Levy et al. | |
| D472,418 | S | | 4/2003 | Gilmore et al. | |
| 6,583,189 | B1 | | 6/2003 | King | |
| 6,592,789 | B2 | | 7/2003 | Barsby | |
| 6,601,637 | B2 | | 8/2003 | Toti | |
| 6,615,895 | B2 | | 9/2003 | Marocco | |
| D480,250 | S | | 10/2003 | Nainee | |
| D481,575 | S | | 11/2003 | Steinberg | |
| 6,673,176 | B2 | | 1/2004 | Rupel | |
| 6,688,373 | B2 | | 2/2004 | Corey et al. | |
| 6,772,815 | B1 | | 8/2004 | Judkins | |
| 6,880,588 | B2 | | 4/2005 | Barsby | |
| 6,991,020 | B1 | | 1/2006 | Cheng et al. | |
| 7,021,359 | B2 | | 4/2006 | Yu et al. | |
| D541,094 | S | | 4/2007 | Yu et al. | |
| D554,422 | S | | 11/2007 | Lin | |
| 7,360,573 | B2 | | 4/2008 | Yu et al. | |
| D595,078 | S | | 6/2009 | Kollman et al. | |
| D595,984 | S | | 7/2009 | Kollman et al. | |
| D600,484 | S | | 9/2009 | Anderson et al. | |
| 7,950,437 | B2 | | 5/2011 | Lin | |
| 2001/0040014 | A1 | | 11/2001 | Green et al. | |
| 2001/0054490 | A1 | | 12/2001 | Corey et al. | |
| 2002/0040770 | A1 | | 4/2002 | Colson et al. | |
| 2003/0168183 | A1 | | 9/2003 | Franco et al. | |
| 2003/0205336 | A1 | | 11/2003 | Marocco | |
| 2003/0205339 | A1 | | 11/2003 | Colson et al. | |
| 2004/0123959 | A1 | | 7/2004 | Toti | |
| 2004/0154755 | A1 | | 8/2004 | Judkins | |
| 2004/0154758 | A1 | | 8/2004 | Cheng et al. | |
| 2004/0231803 | A1 | | 11/2004 | Cheng et al. | |
| 2005/0022947 | A1 | | 2/2005 | Yu et al. | |
| 2006/0022376 | A1 | | 2/2006 | Prince et al. | |
| 2006/0113046 | A1 | | 6/2006 | Prince et al. | |
| 2012/0111509 | A1 | | 5/2012 | Mullet et al. | |
| 2012/0261852 | A1 | | 10/2012 | King et al. | |
| 2014/0238622 | A1 | | 8/2014 | Patterson et al. | |
| 2014/0246156 | A1 | | 9/2014 | Dorny et al. | |

FOREIGN PATENT DOCUMENTS

| | | | |
|---|---|---|---|
| WO | WO 02/06619 | A1 | 1/2002 |
| WO | WO 2005/112585 | A2 | 12/2005 |
| WO | WO 2006/096188 | A2 | 9/2006 |
| WO | WO 2009/149708 | A1 | 12/2009 |
| WO | WO 2014/131022 | A1 | 8/2014 |
| WO | WO 2014/131057 | A1 | 8/2014 |
| WO | WO 2014/134074 | A1 | 9/2014 |

OTHER PUBLICATIONS

CDC, "Isocyanates, NIOSH Workplace Safety and Health Topic", Publication No. 2008-109 (Jan. 2008), pp. 1-5, as accessed on Apr. 12, 2011, http://www.cdc.gov/niosh/topics/isocyanates/.

* cited by examiner

SYSTEM FOR PIVOTING A BLIND SLAT

RELATED APPLICATIONS

This application claims priority to U.S. Provisional Application Ser. No. 61/768,957, filed Feb. 25, 2013 and titled "SYSTEM FOR PIVOTING A BLIND SLAT" which is incorporated herein in its entirety.

BACKGROUND OF THE INVENTION

1. Field of the Invention

The present invention relates generally to blinds or coverings for windows or for other similar openings. More particularly, the present invention relates to a window covering having a blind slat that is rotated clockwise and counter-clockwise by rotating a driving mechanism that is positioned in a horizontal orientation. The present invention further relates to a window covering system that achieves tilting of blind slats without requiring the traditional tilting components of standard Venetian-type blinds.

2. Background and Related Art

Blinds are often used to cover windows and other similar openings to provide privacy and/or to control the level of light that enters a room. A popular type of blind, sometimes called a "Venetian" blind, comprises a series of spaced-apart blind slats assembled parallel to each other. As a type of window covering, Venetian blinds offer versatility in controlling light or view and are easy to use.

A common, commercially available Venetian blind generally includes a head rail, a bottom rail, a plurality of blind slats, and means for tilting the blind slats. Some commercially available Venetian blinds further include means for lifting and gathering the blind slats at a position adjacent the head rail. The slats are generally suspended from the head rail via a system of cords that form a ladder. The ladder comprises forward and rearward rails that are interconnected with a plurality of rungs. Each rung of the ladder is configured to hold a blind slat at a desired distance from an adjacent blind slat. The ladder is further connected to the head rail and the bottom rail.

Tilting the blind slats causes each slat to pivot about a point on the rung. Tilting is generally accomplished via a tilting drum that is secured to a tilting rod located in the head rail. The ladder is attached to the tilting drum so that as the tilting rod is rotated, the tilting drum is also rotated. The forward and rearward rails of the ladder are coupled to the tilting drum such that as the tilting drum rotates, the vertical positions of the forward and rearward rails are adjusted up and down. This up and down movement tilts the rungs of the ladder, thereby tilting the blind slats supported thereon.

The components of the tilting means for a traditional Venetian blind can be quite complex, expensive, bulky and heavy. The head rails of traditional Venetian blinds are required to have a minimum size necessary to accommodate the various components to achieve tilting. For example, the tilting drum assembly of a traditional Venetian blind must comprise a diameter with a ratio to the width of the blind slat that is large enough to accommodate complete rotation of the blind slat. Thus, the head rail must have a minimum width and height that is approximately equal to the width of the blind slat. This generally provides a head rail that is large and bulky. A valance is commonly used to address this issue by covering or disguising the bulky head rail.

Further, in some instances the components of the tilting means for a traditional Venetian blind provide a barrier to achieving superior closure of the blind. For example, the minimum width of the tilting drum may prevent complete closure of the upper-most blind slat, i.e. the blind slat that is closest to the head rail. This is due to the inability of the forward and rearward rails of the ladder to close or be brought close together sufficiently due to the required minimum width of the tilting drum. As such, light-leakage commonly occurs between the upper-most blind slat and its adjacent blind slat when the window covering is closed.

Thus, while techniques currently exist relating to Venetian blind systems, challenges still exist, including complex, expensive, bulky, and heavy components of the traditional Venetian blind systems. Accordingly, it would be an improvement in the art to augment or even replace current techniques with other techniques.

SUMMARY OF THE INVENTION

The present invention relates generally to blinds or coverings for windows or for other similar openings. More particularly, the present invention relates to a window covering having a blind slat. The present invention further relates to a window covering system that achieves tilting of blind slats without requiring the traditional tilting components of standard Venetian-type blinds.

Some implementations of the present invention include a window covering having a head rail comprising a plate which includes a top surface, a bottom surface, a front edge, and a rear edge. In some implementations, the head rail comprises a u-channel in which various components of the window covering are concealed. In other implementations, the top surface of the plate is configured to attach to a window opening, and the various components of the window covering are attached to the bottom surface of the plate. In some instances, the window covering further includes an axle that is coupled to the top surface of the head rail and extends between the front edge and the rear edge of the head rail. The axle may be directly or indirectly coupled to the head rail. The axle may further include a front end, a rear end, and a length extending therebetween. In some instances, the window covering further includes at least one guide that is slidably threaded onto the axle and is moveable between the front end and rear end of the head rail along the length of the axle.

In some instances, a window covering is provided which includes a cord support comprising a grommet that is placed in an opening of the head rail and configured to prevent contact between cords and the head rail as the cords passed through the opening. In some embodiments, a window covering is provided comprises one or more openings that are elongated. For example, in some instances a window covering is provided having an elongated opening, wherein the length of the elongated opening is approximately equal to, or slightly less than a width of the head rail.

The window covering further includes a blind slat having a first edge and a second edge. The blind slat is suspended below the head rail by an anchor cord and a tilt cord. The anchor cord is coupled directly or indirectly to the head rail at one end, and also coupled to the blind slat at an opposite end. In some instances, the distance between the blind slat and the head rail is fixed via the anchor cord. In other words, the length of the anchor cord remains constant throughout the tilting of the blind slat. The tilt cord is coupled to the blind slat at a position opposite the anchor cord through an opening in the head rail. In some instances the tilt cord comprises a first end, a second end, and middle extending therebetween, wherein the middle is positioned on the guide, and the second extends outwardly therefrom. The edge of the blind slat coupled to the tilt cord is raised and lowered with respect to the head rail as the tilt cord is passed over the guide. Thus, tilting of the blind slats is accomplished without requiring the tilting rod and tilting drum of traditional Venetian blind systems. Further, the window covering systems of the present invention allow use of a thin-profile head rail.

BRIEF DESCRIPTION OF THE DRAWINGS

The foregoing and other objects and features of the present invention will become more fully apparent from the accompanying drawings when considered in conjunction with the following description. Although the drawings depict only typical embodiments of the invention and are thus not to be deemed as limiting the scope of the invention, the accompanying drawings help explain the invention in added detail.

DETAILED DESCRIPTION OF THE INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

A purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are designated by like numeric characters throughout.

Figure 1A:
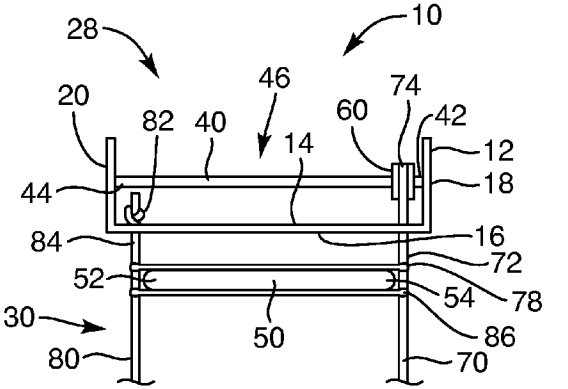
FIG. 1A is a cross-section view of a head rail and blind slat in an opened position in accordance with a representative embodiment of the present invention.

Referring now to FIG. 1A, a cross-section end view of a window covering 10 is shown. Generally, window covering 10 includes a window blind that is configured to cover a window opening. Window covering 10 may include any material or combinations of materials as may be desired. Window covering 10 may further include any dimensions desired to cover or partially cover an opening. In some instances, window covering 10 is configured to cover a window that is part of a door, or another non-traditional type of window. Window covering 10 may further be used in combination with another type of traditional window covering, such as a set of curtains or a pull shade.

In some embodiments, window covering 10 comprises a horizontal window blind, wherein window covering 10 comprises a plurality of horizontal blind slats 50 that span the distance across a desired opening. Horizontal blind slats 50 may comprise any material. For example, horizontal blind slats 50 may include wood, metal, fabric, plastic, thermoplastic, thermoset, and composite materials, as well as any material comprising a combination of the materials stated herein. Horizontal blind slats 50 may further include any structural or ornamental configuration, as may be desired. For example, in some embodiments horizontal blind slats 50 are flat. In other embodiments, horizontal blind slats 50 comprise a crescent cross-section. Other cross-section profiles for horizontal blind slat 50 include wavy, convex, concave, rectangular, ellipsoid, and double convex. Horizontal blind slats 50 may further include other structural or design features. For example, horizontal blind slats 50 may include a painted surface, embossing, a veneer, a texture, a printed design or color, a coating, or a paper covering.

Horizontal blind slats 50 generally comprise a distal side 52, and a proximal side 54, wherein the blind slat is positioned below the bottom surface 16 of head rail 12. For purposes of describing various embodiments of the present invention, distal side 52 is generally positioned towards a window opening when the window blind 10 is in an open position, and proximal side 54 is generally position opposite the window opening when the window blind 10 is in an opened position.

In some embodiments, window covering 10 comprises a plurality of horizontally-oriented slats 50 that are suspended from a head rail 12 via a system of tilt cords or ropes 30 which form a ladder. In some instances, head rail 12 comprises a u-channel 28 that is configured to be attached to a surface adjacent a window opening. Head rail 12 comprises a top surface 14, a bottom surface 16, a front edge 18 and a rear edge 20. In some embodiments, front and rear edges 18 and 20 form the walls of u-channel 28 and conceal the contents of window covering 10 positioned therein. In other embodiments, head rail 12 comprises a plate having a top surface that is configured to attach head rail 12 to a window opening, and further comprising a bottom surface that is configured to receive the various components of window covering 10. Thus, window covering 10 may be used in both regular and inverted configurations.

Head rail 12 may comprise any material that is compatible for use in supporting horizontal blind slats 50. For example, in some embodiments head rail 12 comprises a metallic material, such as steel or aluminum. Head rail 12 may further include a polymer material, such as polystyrene, polyethylene, polyurethane, polycarbonate, and polyvinylchloride, ABS or a combination thereof. Head rail 12 may be formed by bending the metallic material into a desired shape, or may be provided by an extrusion or molding process.

The u-channel 28 of head rail 12 may be useful for coordinating and concealing various working components of window covering 10. In contrast to the dimensional limitations of traditional head rails for Venetian blind systems, head rail 12 of the present invention may include a low-profile head rail, thereby obviating the need for a valance or other means for disguising the head rail. In some embodiments, a low-profile head rail is possible due to the elimination of the tilt drum and tilt rod components of the traditional Venetian blind systems. Some embodiments of the present invention utilize an axle and guide system, or another form of a cord support which may be accomplished with minimal dimensional limitations. Accordingly, a head rail of the present invention may be minimized by providing a cord support having a minimum height. For example, in some instance a head rail is provided having height that is less than 0.5 inches. In other instance, a head rail is provided having a height that is greater than, or equal to 0.5 inches.

In some embodiments, head rail 12 comprises a cord support that is configured to support a middle portion of a tilt cord or string used to manipulate a pivoted angle of blind slat 50. In some instances, a cord support is provided comprising an axle 40 having a front end 42, a rear end 44, and a length 46 extending therebetween. In some instances, head rail 12 comprises a plurality of axles, wherein each axle is configured to support one or more tilt cords and/or lift cords. Axle 40 may be directly or indirectly coupled to head rail 12. For example, in some instances front end 42 and rear end 44 of axle 40 are directly coupled to head rail 12 via holes provided in head rail 12. In other instances, axle 40 is indirectly coupled to head rail 12 via a bracket or housing that is directly coupled to head rail 12.

In some embodiments, axle 40 is coupled to top surface 14 and extends between front edge 18 and rear edge 20 of head rail 12. In some instances, axle 40 is fixedly coupled to head rail 12. In other instances, axle 40 is coupled to head rail 12 such that axle 40 is able to rotate about its linear axis. For example, a bearing (not shown) may be interposedly positioned between front and rear ends 42 and 44 of axle and front and rear edges 18 and 20 of head rail 12, respectively.

Axle 40 is generally provided as a representative example for means for facilitating movement of tilt cords 30 to assist in rotating blind slats 50 of window covering 10. In some embodiments, tilt cords 30 are placed directly in contact with axle 40 across length 46. In this manner, tilt cords 30 travel through head rail 12 in direct contact with axle 40. In other embodiments, axle 40 further comprises one or more guides 60 which are slidably threaded onto axle 40 and moveable between front and rear ends 42 and 44 along the length 46 of axle 40. In some instances, one or more guides 60 further comprise a cord guard that prevents displacement of tilt cords 70 and/or 80 from guides 60. For example, guides 60 may include a cap or a keeper (not shown) that is positioned over a groove in guides 60 to prevent tilt cords 70 and 80 from being displaced from the groove during use of the window covering.

Guides 60 may include any material that is compatible for use in a window covering. For example, in some embodiments guides 60 comprise a nylon polymer material, ABS, PVC or other polymer material. In other embodiments, guides 60 comprise a metallic material, such a steel or brass. Guides 60 may further include a wood material or a composite material, as may be desired.

Tilt cords 30 are generally provided to suspend blind slats 50 at a position beneath head rail 12. Tilt cords 30 are further provided to assist a user in articulating or rotating blind slats 50 between open and closed positions. Generally, a user may manipulate one or more tilt cords 30 to select a desired rotated position of blind slats 50 relative to the constant position of head rail 12. Tilt cords 30 may further include a lift cord 120 whereby a user may gather all of the blind slats 50 in a compact group at a position adjacent to bottom surface 16 of head rail 12.

Referring now to FIGS. 1A-1F, in some embodiments tilt cords 30 include a first tilt cord 70 having a second end 72 coupled to a proximal side 54 of blind slat 50 through an opening 22 (see FIG. 3) of head rail 12. Opening 22 may comprise any width and length as may be desired. For example, in some instances opening 22 comprises a circular opening having a diameter that is larger or slightly larger than a diameter of tilt cords 30, as shown in FIGS. 6A and 6B. In other instances, opening 22 comprises an elongated opening having a length that is approximately equal to, or slightly less than a width of head rail 12, as shown in FIGS. 1A-5B and 7A-8. In some embodiments, head rail 12 comprises a plurality of openings 22 having various dimensions.

With continued reference to FIGS. 1A-1F, in some instances second end 72 is coupled to blind slat 50 via a ladder having a top portion of strings comprising a rung 78 and a bottom portion of strings comprising a rung 86, such that blind slat 50 secured between the two. In other embodiments, second end 72 is coupled to blind slat 50 via a clip, knot, bead stop or other compatible feature (not shown). Top and bottom rungs 78 and 86 maintain the axial position of blind slat 50 when tilted. In some instances, top and bottom rungs 78 and 86 permit movement of proximal side 54 in upward and downward directions as tilt cords 30 are adjusted. In other embodiments, blind slat 50 is coupled to tilt cords 30 via a retention clip (not shown) thereby securing blind slat 50 to tilt cords 30 without top rung 78.

Figure 1B:
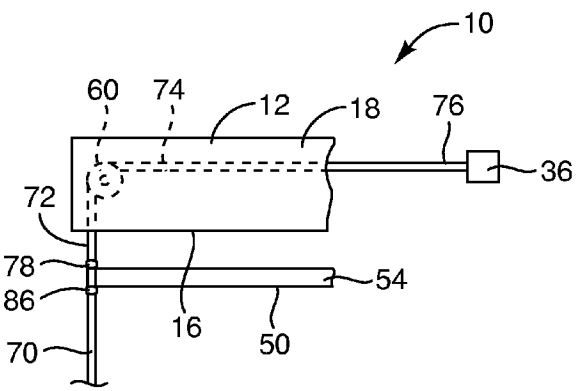
FIG. 1B is plan front view of the device shown in FIG. 1A in accordance with a representative embodiment of the present invention.

In FIGS. 1A and 1B, first tilt cord 70 further comprises a middle portion 74 that that is positioned over guide 60, wherein guide 60 comprises a surface configured to receive first tilt cord 70. For example, in some instances guide 60 comprises a groove configured to receive middle portion 74 of first tilt cord 70. As the first or free end 76 of first tilt cord 70 is pulled and released, middle portion 74 of cord 70 travels over guide 60 to lower and/or raise second end 54 of blind slat 50 relative to bottom surface 16 of head rail 12. This pivoting motion of blind slat 50 opens and closes blind slat 50 of window covering 10. In some embodiments, window covering 10 further comprises a cord retention device 36 which is configured to lock and maintain a desired position of second end 76. Cord retention device 36 may include any component compatible for use with a window covering. For example, in some embodiments cord retention device 36 comprises a cord cleat, a cord lock, or a spring recoil pulley, motor, friction device, counter-weight, worm gear, cogs, pulley or other similar devices.

Figure 1C:
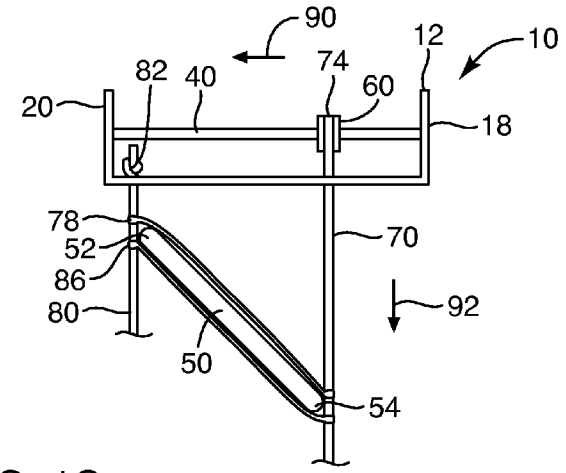
FIG. 1C is a cross-section view of a head rail and blind slat in a partially-closed position in accordance with a representative embodiment of the present invention.
Figure 1D:
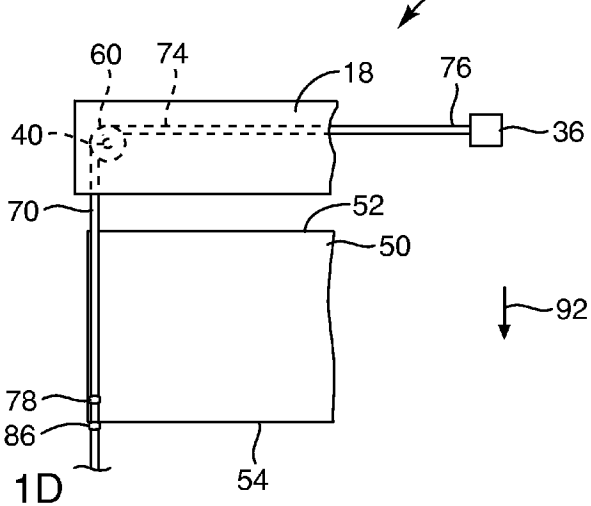
FIG. 1D is a plan front view of the device shown in FIG. 1C in accordance with a representative embodiment of the present invention.
Figure 1F:
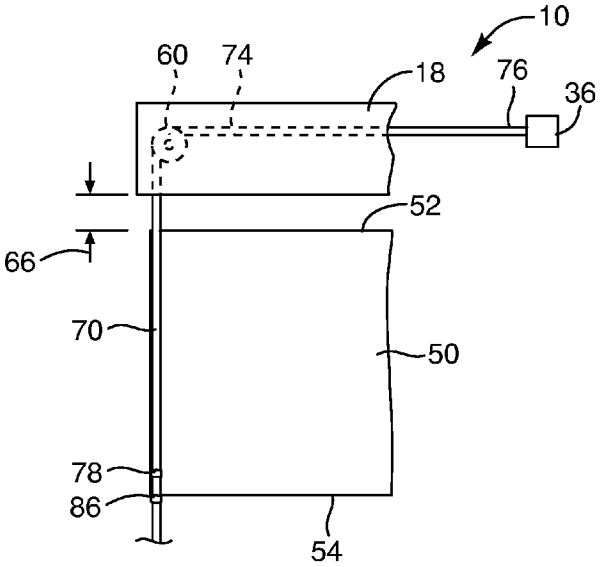
FIG. 1F is a plan front view of the device shown in FIG. 1E in accordance with a representative embodiment of the present invention.
Figure 1G:
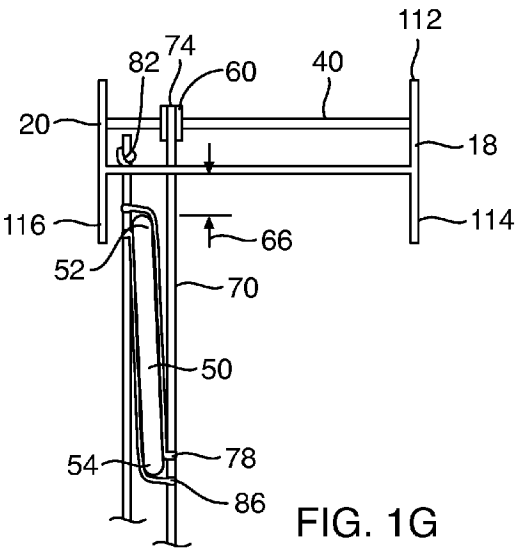
FIG. 1G is a cross-section view of a head rail having an I-beam cross-section configuration thereby providing a front and rear light shield in accordance with a representative embodiment of the present invention.
Figure 1E:
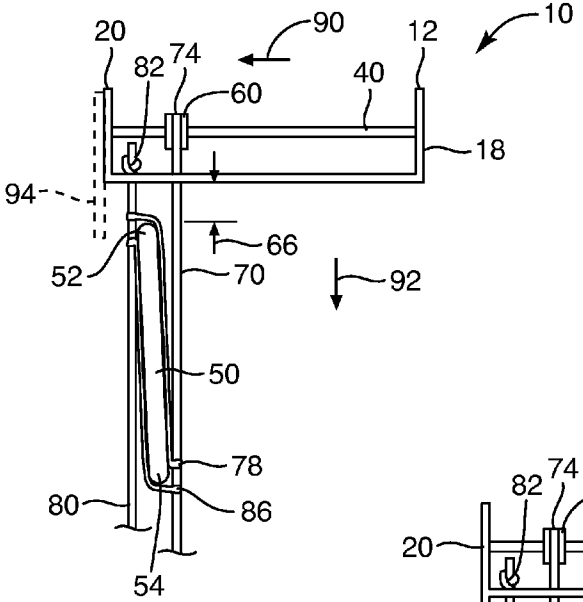
FIG. 1E is a cross-section view of a head rail and blind slat in a closed position in accordance with a representative embodiment of the present invention.
Figure 2A:
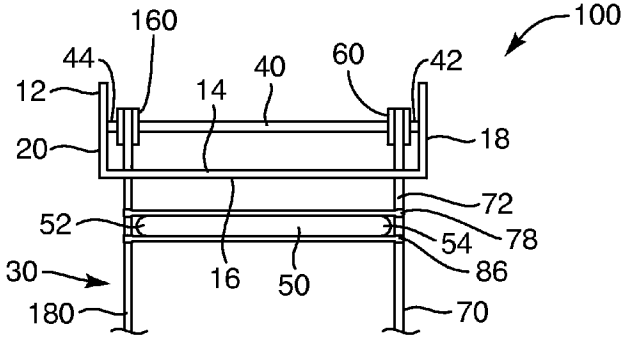
FIG. 2A is a cross-section view of a head rail and a blind slat in an open position in accordance with a representative embodiment of the present invention.

With continued reference to FIGS. 1A and 2A, tilt cords 30 further include an anchor cord 80. Anchor cord 80 comprises a first end 82 that is fixedly coupled to head rail 12, and a second end 84 that is coupled to the distal side 52 of blind slat 50. The distance between second end 84 and head rail 12 is fixed and maintained such that proximal side 54 pivots upward and downward about the fixed position of distal side 52, as shown in FIGS. 1C-1G.

Referring now to FIGS. 1C and 1D, window covering 10 is shown in a partially-closed position. As second end 76 is release from cord retention device 36, first tilt cord 70 simultaneously moves in a distal direction 90 and a downward direction 92 thereby lowering proximal side 54 of blind slat 50. The position of first edge 52 remains constant as blind slat 50 is rotated in a clockwise direction about first edge 52. Accordingly, proximal side 54 is drawn inwardly towards the window opening and/or rear edge 20 of head rail 12. As proximal side 54 moves towards the window opening, guide 60 slides along axle 40 in distal direction 90 towards rear edge 20 of head rail 12.

Upon further release of first tilt cord 70, first tilt cord 70 is further relaxed, proximal side 54 is completely release, and allowed to hang from distal side 52 with anchor cord 80 in an approximate vertical position, as shown in FIGS. 1E and 1F. In this position, guide 60 is further slid inwardly 90 on axle 40 to a position that is approximately in the same vertical plane as proximal side 54.

In some embodiments, window covering 10 comprises a plurality of blind slats, as is common with traditional horizontal blinds. Window covering 10 further comprises a plurality of axles and guides which are spaces along the length of the blind slats within u-channel 46 of head rail 12. Further still, in some embodiments window covering 10 comprises a plurality of top rungs and bottom rungs forming a ladder system that holds and coordinates the plurality of blind slats with a desired spacing. Generally, a desired spacing between adjacent blind slats is selected such that when the blind slats are in a closed position the proximal side 54 of an upper blind slat overlaps a distal side 52 of a lower blind slat, as is common with traditional horizontal blinds.

One having skill in the art will recognize that locations of first tilt cord 70 and anchor cord 80 may be reversed, whereby anchor cord 80 is coupled to proximal side 54 of blind slat 50, and first tilt cord 70 is coupled to distal side 52 of blind slat 50. As such, the process of closing window covering 10 will result in distal side 52 moving away from the window opening as guide 60 slides along axle 40 outwardly towards front edge 18 of head rail 12. Once completely closed, distal side 52 is completely released and allowed to hang from proximal side 54 in a vertical position approximately within the same plane as front edge 18.

In some embodiments, the closed position of window covering 10 may provide a small gap 66 between distal side 52 of blind slat 50 and bottom surface 16 of head rail 12. Light from the window opening may then be seen through gap 66 when observing window covering 10. Accordingly, in some embodiments window covering 10 further comprises a light shield 94 that is coupled to rear edge 20 of head rail 12, as shown in FIG. 1E. Light shield 94 overlaps gap 66 to block light from leaking through gap 66. In some embodiments, head rail 12 is molded to include light shield 94 as an integrated part of head rail 12. In other embodiments, light shield 94 comprises a separate component that is capable of being added to head rail 12.

Further, in some embodiments, head rail 112 comprises an I-beam cross-section configuration, as shown in FIG. 1G. The I-beam configuration provides a front light shield 114 and a rear light shield 116, as shown. Alternatively, a removable light shield may be added to either front edge 18 or rear edge 20 of head rail 12, as may be desired.

In some embodiments, a window covering is provided which is capable of tilting and closing the blind slats in either a clockwise or counter-clockwise direction. As such, a user may adjust the window covering to achieve a desired amount of light blocking and an overall appearance of the window covering.

Referring now to FIGS. 2A-2D, a window covering 100 is shown comprising a head rail 12 having a first guide 60 coupled to first tilt cord 70, and further having a second guide 160 coupled to a second tilt cord 180. First and second guides 60 and 160 are slidably and rotatably threaded onto axle 40 and moveable between proximal end 42 and distal end 44 of axle 40. First and second guides 60 and 160 are slid along the length of axle 40 as blind slat 50 is tilted and closed in either a clockwise or counter-clockwise direction. The clockwise and counter-clockwise tilting directions are achieved by adjusting tilt cords 70 and 180 via first and second cord retention devices 36*a* and 36*b*, as described below.

Figure 2C:
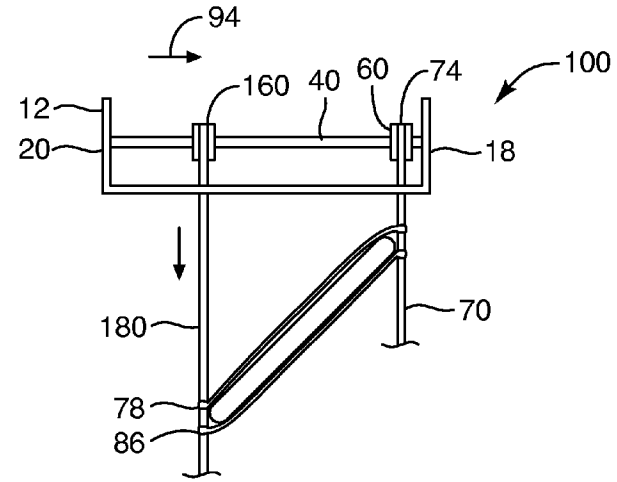
FIG. 2C is a cross-section view of a head rail and blind slat in a partially-closed position in accordance with a representative embodiment of the present invention.

In some embodiments, blind slat 50 is tilted in a counter-clockwise direction by releasing the position of second tilt cord 180 while maintaining the fixed position of first tilt cord 70. In this way, the fixed position of first tilt cord 70 provides an equivalent function of anchor cord 80 of window device 10. Upon releasing rear tilt cord 180, blind slat 50 is pivoted about proximal side 54, as shown in FIG. 2C. Upon complete release of rear tilt cord 180 from second cord retention device 36*b*, distal side 52 of blind slat 50 is allowed to hang from proximal side 54 in a vertical position in proximity to the same vertical plane as front edge 18.

Conversely, blind slat 50 may be tilted and closed in a clockwise direction by releasing the position of first tilt cord 70 from the first cord retention device 36*a* while maintaining the position of rear tilt cord 180, as shown in FIG. 2A. In this way, the fixed position of rear tilt cord 180 provides an equivalent function of anchor cord 80 of window device 10. Upon releasing first tilt cord 70, blind slat is pivoted about distal side 52 on rear tilt cord 180. Upon complete release of first tilt cord 70, proximal side 54 of blind slat 50 is allowed to hang from distal side 52 in a vertical position in proximity to the same vertical plane as rear edge 20.

Figure 2B:
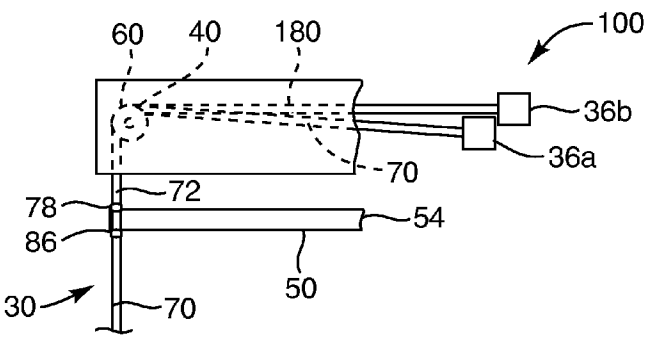
FIG. 2B is a plan front view of the device shown in FIG. 2A in accordance with a representative embodiment of the present invention.

In some embodiments, window covering 100 comprises a first cord retention device 36*a* configured to control movement of first tilt cord 70, and a second cord retention device 36*b* configured to control movement of second tilt cord 180, as shown in FIG. 2B. Generally, first and second cord retention devices 36*a* and 36*b* are configured to control their respective tilt cords independent of the other cord retention device. As such, a user may selectively adjust one tilt cord independent of the other cord.

In some embodiments, first and second cord retention device 36*a* and 36*b* may be simultaneously adjusted to adjust the tilt cords in opposing directions to pivot the blind slat. For example, in some instances first and second tilt cords are coupled to a single device that is rotated or otherwise manipulated to shorten one tilt cord while simultaneously lengthening the other tilt cord, thereby tilting the blind slat. For example, first and second tilt cords may be coupled to a single cord retention device comprising a pulley having one or more surfaces to receive the tilt cords. By rotating the pulley, the first tilt cord is lengthened and the second tilt cord is shortened, thereby tilting the blind slat. Further, in some instances first and second tilt cords may be independently and adjustably retained within a single cord retention device that is configured to permit independent adjustment of the tilt cords to achieve tilting of a blind slat.

Figure 2D:
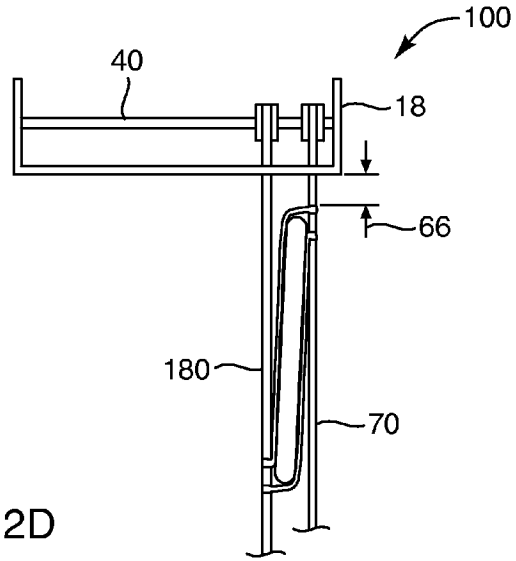
FIG. 2D is a cross-section view of a head rail and blind slat in a closed position in accordance with a representative embodiment of the present invention.

This feature of independent adjustability may be useful for situations where it is desirable to have the tilt cords at different positions. For example, once window covering 100 has been closed, as shown in FIG. 2D, it may be desirable to close gap 66 by further withdrawing first tilt cord 70 using cord retention device 36*a*. As discussed previously, first guide 60 and rearward guide 160 slide inwardly 90 and outwardly 94 along axle 40 as blind slat 50 is tilted in clockwise and counter-clockwise directions, respectively.

Figure 3B:
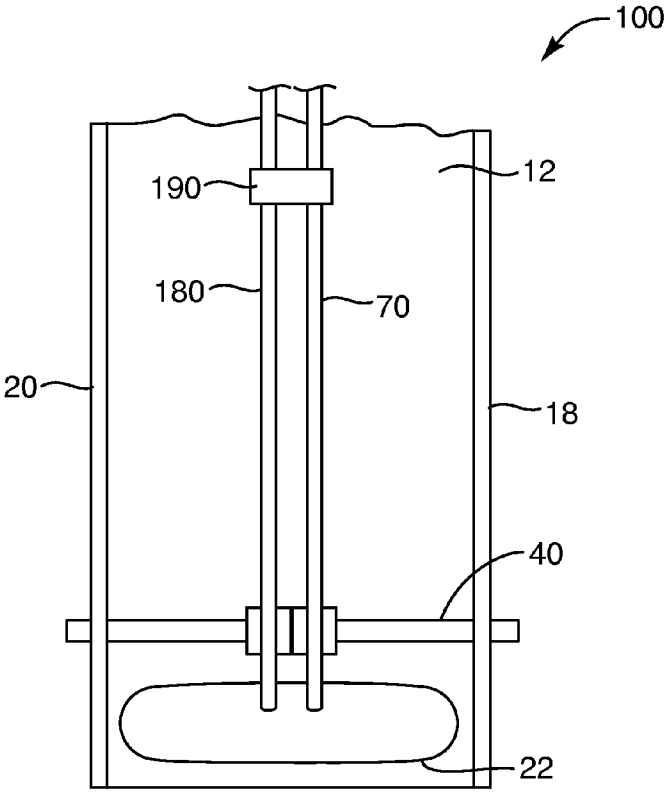
FIG. 3B is a top view of a head rail having an eyelet and a plurality of blind slats in a closed position in accordance with a representative embodiment of the present invention.
Figure 3A:
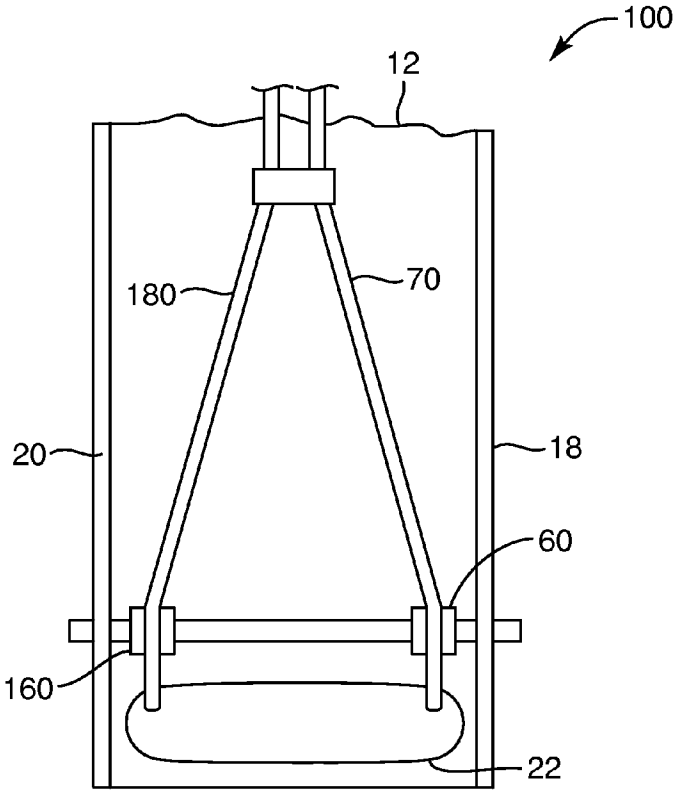
FIG. 3A is a top view of a head rail having an eyelet and a plurality of blind slats in an open position in accordance with a representative embodiment of the present invention.

In some embodiments, head rail 12 further comprises an eyelet 190 which is coupled to the top surface of head rail 12 at a generally centered position across the width of head rail 12, as shown in FIGS. 3A and 3B. Eyelet 190 may comprise any structure or design that is capable of controlling the position of tilt cords 70 and 180 within head rail 12. For example, eyelet 190 may include a cord guide, a pulley, a retainer, a post, a pin, a grommet, a stringer, a hook, a loop, a tube, or a similarly compatible structure.

In some instances, eyelet 190 comprises an opening through which first and second tilt cords 70 and 180 are threaded prior to being supported or contacting the cord support element, such as guides 60 and 160. The position of eyelet 190 on head rail 12 determines the relative alignment of blind slats 50 when rotated to a closed position. For example, if eyelet 190 is centrally positioned on head rail 12, then blind slats 50 will align centrally under head rail 12 when rotated to a closed position. If eyelet 190 is positioned adjacent to front edge 18 or rear edge 20, blind slats 50 will align proximate to front edge 18 or rear edge 20, respectively.

Prior to being rotated into a closed position, the rigid nature of blind slats 50 causes first and second guides to be held in proximal and distal positions with a space between the guides that is approximately equal to the width of blind slats 50, as shown in FIG. 3A. The central location of eyelet 190 provides central alignment of blind slats under head rail 12 when in an opened position. Further, when blind slats 50 are rotated to a closed position, blind slats 50 are aligned centrally beneath head rail 12, as shown in FIG. 3B. Accordingly, proximal, distal or central alignment of blind slats 50 may be accomplished by selecting the position of eyelet 190. Eyelet 190 further permits the first ends of first and second tilt cords 70 and 180 to exit head rail 12 at any position without altering the alignment of blind slats 50 in open or closed positions.

Figure 4:
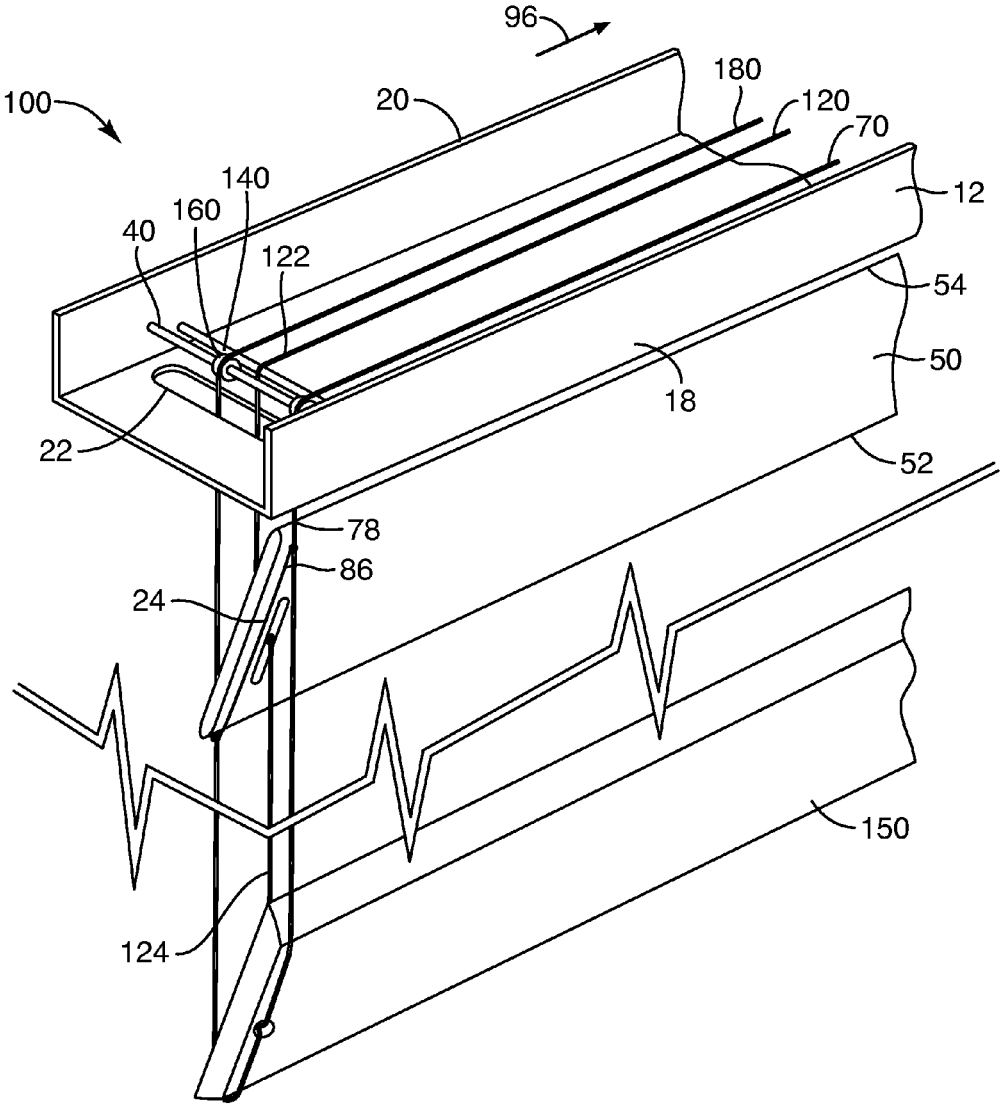
FIG. 4 is a perspective view of a head rail having a lift cord in accordance with a representative embodiment of the present invention.

Referring now to FIG. 4, a perspective top view of window covering 100 is shown. Generally, tilt cords 70 and 180 pass through head rail 12 via an opening 22. In some embodiments, first lift cord 70 passes through head rail 12 via a first opening, and rear tilt cord 180 passes through head rail 12 via a second opening (not shown). Further, in some embodiments window covering 100 comprises a lift cord 120 having a middle portion 122 that passes through an opening 24 in each blind slat. A bottom rail 150 is coupled to a terminal end 124 of lift cord 120. As lift cord 120 is withdrawn in distal direction 96, the bottom rail 150 is lifted by lift cord 120 to gather the blind slats to a final position that is proximate to bottom surface 16 of head rail 12, as is commonly accomplished on traditional horizontal blind window coverings.

In some embodiments, window covering 100 further comprises a second axle 140 that is configured to assist the movement of lift cord 120. Window covering 100 may further include a third opening (not shown) to facilitate passage of lift cord 120 through head rail 12. In other embodiments, second axle 140 is position proximate to opening 22 to permit passage of lift cord 120 through opening 22.

Figure 5A:
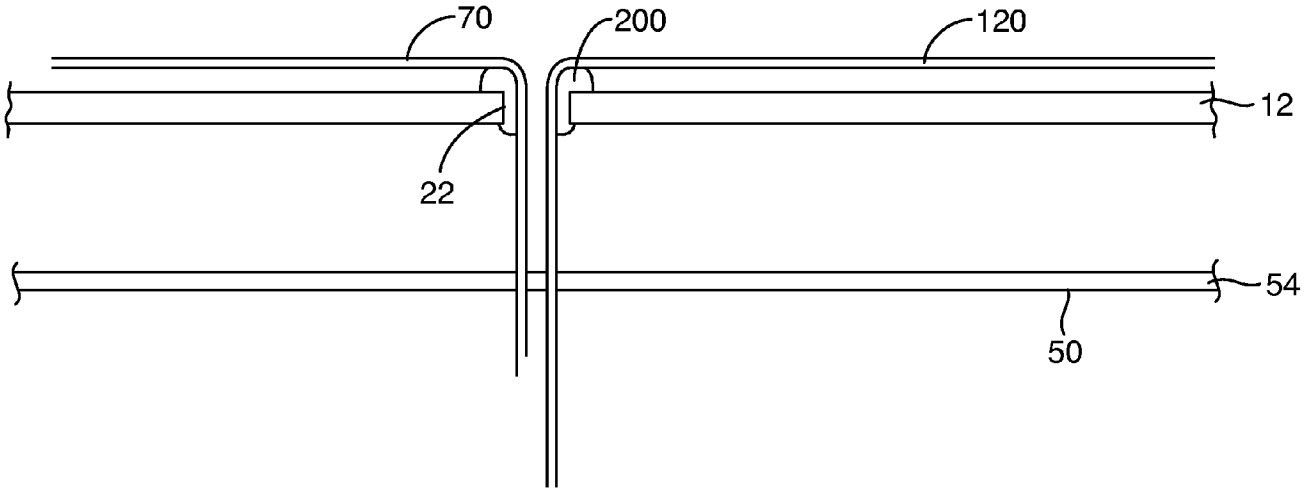
FIG. 5A is a side view of a head rail having a cord support comprising a grommet in accordance with a representative embodiment of the present invention.
Figure 5B:
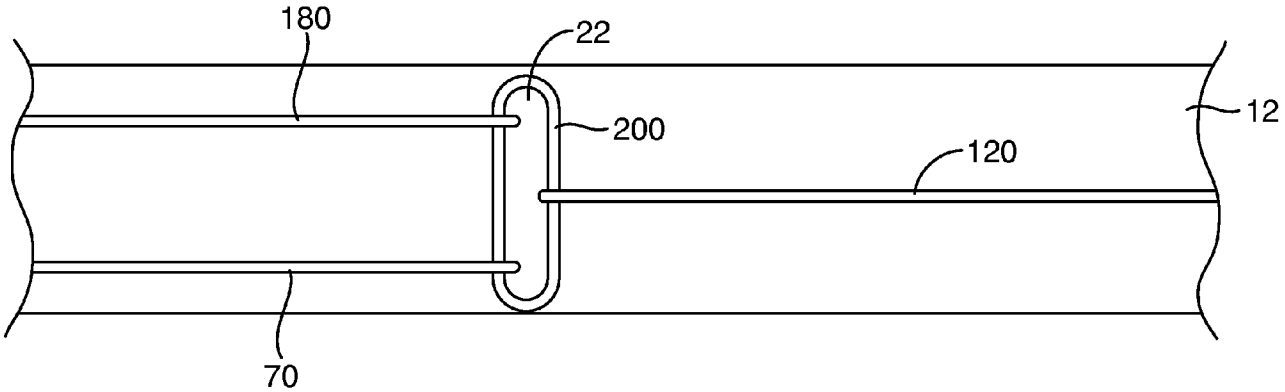
FIG. 5B is a top view of a head rail having a cord support comprising a grommet in accordance with a representative embodiment of the present invention.
Figure 6A:
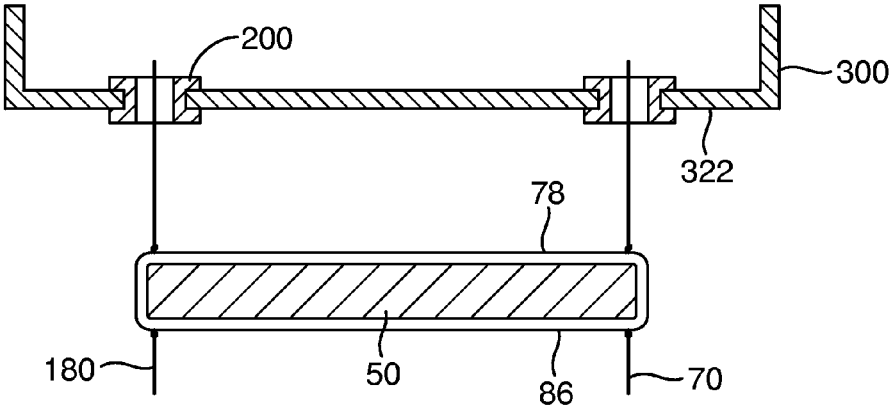
FIG. 6, shown in parts A-C, is a cross section view of a head rail having a plurality of openings in accordance with a representative embodiment of the present invention.
Figure 6B:
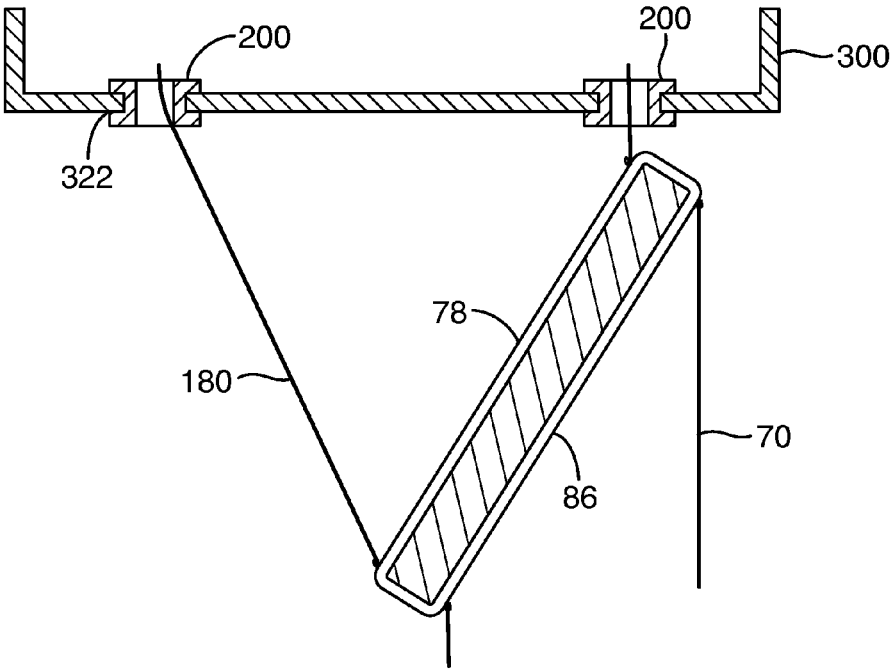

In some embodiments, window covering 100 further includes a cord support comprising a grommet 200 that is fitted into opening 22 to prevent contact between cords 70, 180 and 120, and head rail 12, as shown in FIGS. 5A and 5B. Grommet 200 may comprise any compatible material. In some embodiments grommet 200 comprises a nylon, metal, plastic polymer or Teflon® material.

Grommet 200 is provided in place of the axle and guides of the previous embodiments. Accordingly, grommet 200 may be incorporated into any of the previous embodiments or other adaptations of the present invention, within the purview of one having ordinary skill in the art. By eliminating the axles and guides of the previous embodiments, grommet 200 allows cords 70 and 180 to completely close and contact each other when blind slats 50 are rotated or pivoted to a closed position. Further, grommet 200 provides a simplified blind closure system that may be desirable to reduce costs associated with manufacturing window covering 100.

Referring now to FIGS. 6A and 6B, in some embodiments a head rail 300 is provided comprising a plurality of openings 322, each opening being configured to receive and permit passage of a tilt cord through the head rail. In some instances, pivoting of blind slat 50 is accomplished as tilt cord 180 is released or lengthened while the position of tilt cord 70 remains constant. In some embodiments, tilt cord 70 is further shortened to reduce a distance between blind slat 50 and head rail 300. Further, in some instances pivoting of blind slat 50 is accomplished as tilt cords 70 and 180 are simultaneously adjusted in opposing directions.

Figure 6C:
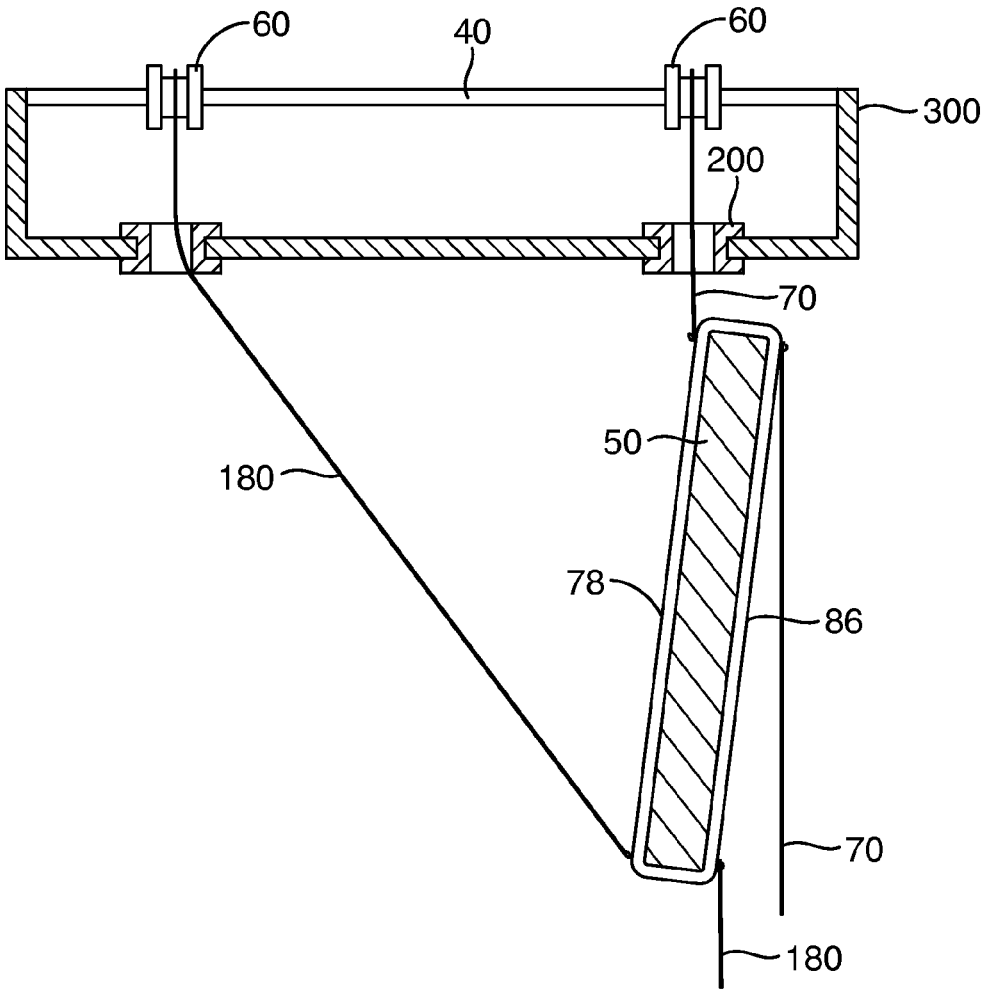

Upon complete release of tilt cord 180, blind slat 50 is permitted to hang from tilt cord 70 in a generally vertical position, as shown in FIG. 6C. Tilt cord 180 assumes a flaccid state and branches diagonally from the distal opening to blind slat 50 which is generally positioned under the proximal side of head rail 300. In some instances, each opening comprises a grommet 200 which is provided to protect tilt cords 70 and 180 as they pass through their respective openings. Tilting of blind slat 50 in a clockwise direction may be accomplished by reversing the movement of the tilt cords, i.e. shortening tilt cord 180 while simultaneously lengthening tilt cord 70. Head rail 300 may further include an axle 40 and guides 60 to further facilitate movement of tilt cords 70 and 180.

In some embodiments, a head rail 400 is provided which comprises an eyelet 450 that is configured to assist movement of guide 60*a* in distal direction 90 when pivoting blind slat 50 from a closed configuration to an open configuration, as shown in FIGS. 7A-7D. Eyelet 450 is positioned on head rail 400 at a position between opening 22 and the cord retention devices (not shown). Eyelet 450 is generally positioned at the distal side of head rail 400. Tilt cord 80 passes through eyelet 450 prior to exiting head rail 400 via opening 22.

Figure 7A:
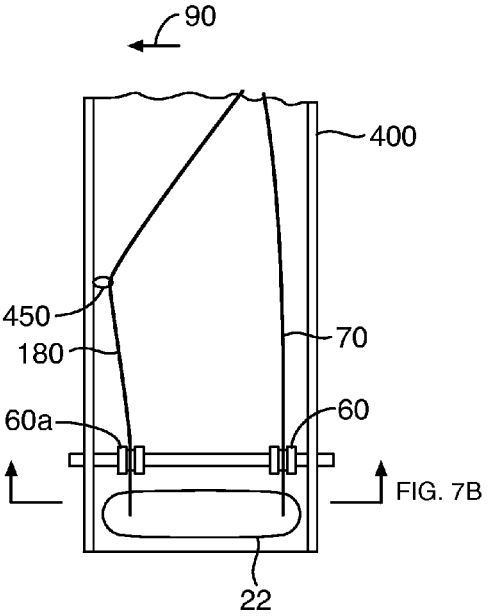
FIG. 7, shown in parts A-D, shows various views of a head rail incorporating one or more eyelets to assist in movement of one or more cord guides in accordance with a representative embodiment of the present invention.
Figure 7B:
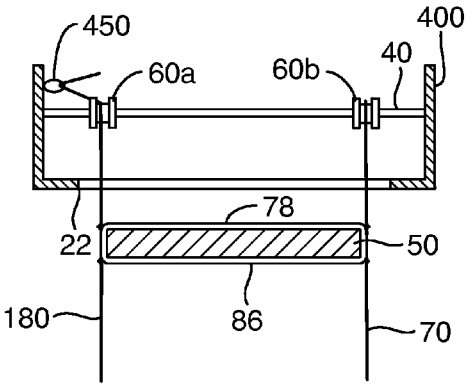
Figure 7C:
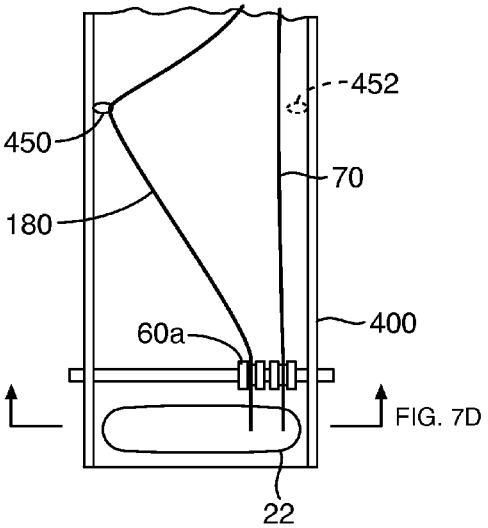
Figure 7D:
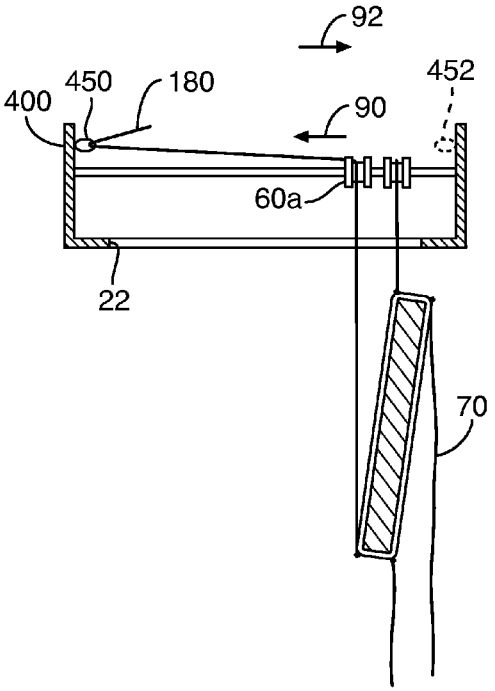

Upon releasing tilt cord 180 from its respective cord retention device, the distal edge of blind slat 50 is rotated in a counter-clockwise direction thereby causing guide 60*a* to slide in proximal direction 92, as shown in FIG. 7D. As tilt cord 180 is pulled, eyelet 450 assists in moving or directing guide 60*a* in distal direction 90, thereby reducing the amount of force required to retract or shorten tilt cord 180. Some embodiments further comprise a second eyelet 452 that is intended for use with tilt cord 70 in a similar manner to eyelet 450 and tilt cord 180. Thus, clockwise and counter-clockwise closure of blind slat 50 may be accomplished with minimal pulling force.

Figure 8:
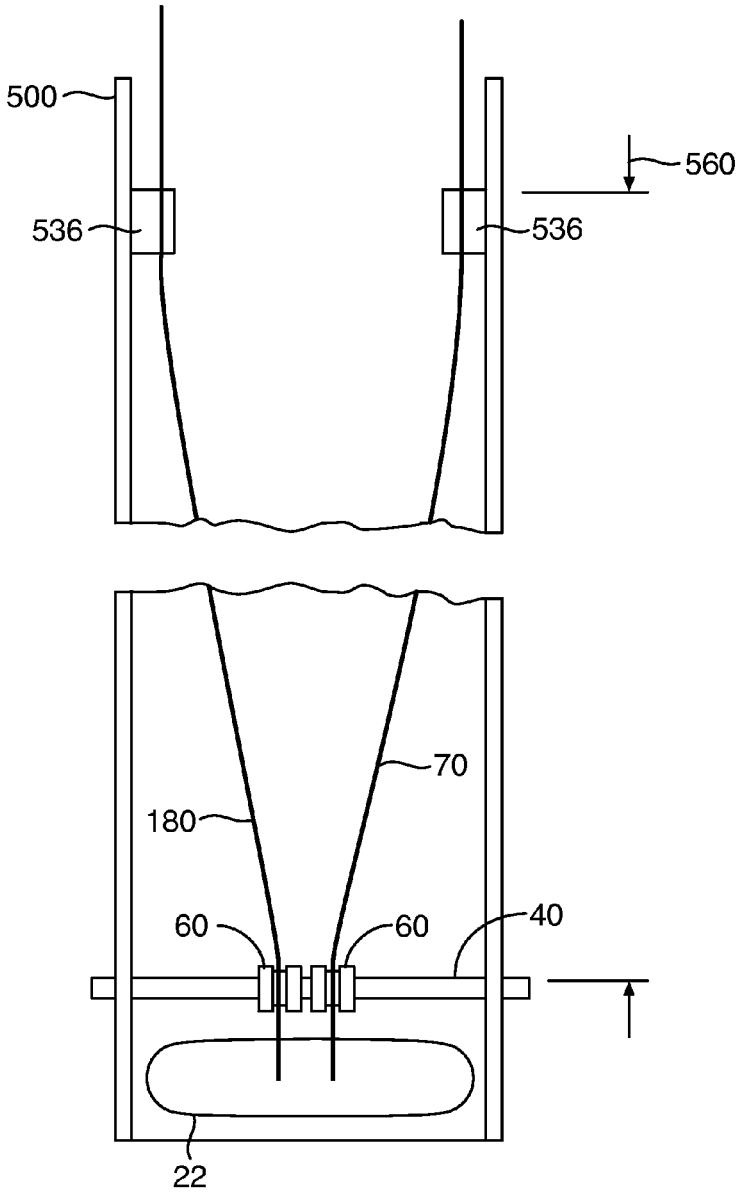
FIG. 8 is a top view of a head rail incorporating oppositely positioned eyelets to achieve center closure of blind slats in accordance with a representative embodiment of the present invention.

Referring now to FIG. 8, a top view of a head rail 500 is shown having a blind slat in a closed configuration. In some embodiments, center alignment of a closed blind slat may be accomplished by passing tilt cords 70 and 180 through eyelets 536 that are located on opposite sides of head rail 500 at a distance 560 from opening 22 and axle 40. Distance 560 may include any distance that permits guides 60 naturally draw center when blind slat 50 is pivoted to a closed position. Distance 560 will vary based upon the characteristics of blind slat 50. For example, the weight and width of blind slat 50, as well as the overall weight of the blinds and bottom rail may allow for a shorter or longer distance 560 between eyelets 536 and opening 22.

It is underscored that the present invention may be embodied in other specific forms without departing from its spirit or essential characteristics. The described embodiments herein should be deemed only as illustrative.

What is claimed is:

1. A system for rotating a blind slat, the system comprising:

a plate;

a blind slat suspended below the plate;

a first tilt cord having a first end, a second end, and a middle portion of the first tilt cord extending therebetween, the first end of the first tilt cord being attached to a first cord retention device, the second end of the first tilt cord being attached to a proximal portion of the blind slat, and the middle portion of the first tilt cord passing through the plate, wherein the first end of the first tilt cord is adjustable within the first cord retention device to change a distance between the second end of the first tilt cord and the plate to at least one of raise and lower the proximal portion of the blind slat with respect to the plate; and a second tilt cord having a first end, a second end, and a middle portion of the second tilt cord extending therebetween, the first end of the second tilt cord being attached to a second cord retention device, the second end of the second tilt cord being attached to a distal portion of the blind slat, and the middle portion of the second tilt cord passing through the plate, wherein the first end of the second tilt cord is adjustable within the second cord retention device to change a distance between the second end of the second tilt cord and the plate to at least one of raise and lower the distal portion of the blind slat with respect to the plate.

2. The system of claim 1, wherein the first and second cord retention devices are configured to allow the first and second tilt cords to be raised and lowered independent of each other.

3. The system of claim 2, further comprising a cord support coupled to the plate and configured to support the middle portion of the first tilt cord.

4. The system of claim 3, wherein the cord support comprises an axle coupled to the plate in proximity to an opening in the plate through which the first tilt cord passes and that is configured to support the middle portion of the first tilt cord through the opening without causing the middle portion of the first tilt cord to contact the plate.

5. The system of claim 4, further comprising a guide rotatably and slidably coupled to the axle and having a surface for receiving the middle portion of the first tilt cord.

6. The system of claim 5, wherein the guide slides along the axle over a length of the opening as a plane of the blind slat is pivoted.

7. The system of claim 3, wherein the cord support comprises a grommet coupled to an opening in the plate through which the first tilt cord passes and wherein the cord support is configured to support the middle portion of the first tilt cord through the opening without causing the middle portion of the first tilt cord to contact the plate.

8. The system of claim 1 wherein the first and second cord retention devices comprise a single cord retention device that is configured to selectively permit individual adjustment of the first and second tilt cords.

9. The system of claim 1, further comprising a guide rotatably and slidably coupled to an axle and having a surface for receiving the middle portion of the first tilt cord.

10. The system of claim 4, further comprising a second guide rotatably and slidably coupled to the axle and having a surface for receiving the middle portion of the second tilt cord.

11. The system of claim 10, wherein the second guide is configured to slide along the axle as the second tilt cord is adjusted within the second cord retention device.

12. The system of claim 4, wherein the opening comprises an elongated opening, and wherein the second tilt cord passes through the opening.

13. A window covering device, comprising:

a head rail having a top surface, a bottom surface, a front edge, and a rear edge;

an axle coupled to the top surface and extending between the front edge and the rear edge of the head rail, the axle having a front portion, a rear portion, and a length extending therebetween;

a first guide and a second guide slidably threaded onto the axle and moveable between the front portion and the rear portion along the length of the axle;

a blind slat having a distal side and a proximal side, the blind slat being positioned below the bottom surface of the head rail;

a first tilt cord having a first end, a second end, and a middle of the first tilt cord extending therebetween, the first end of the first tilt cord being coupled to the distal side of the blind slat, the middle of the first tilt cord extending through the head rail and being positioned on the first guide, and the second end of the first tilt cord extending from the first guide, wherein the distal side of the blind slat is configured to be at least one of lowered and raised with respect to the bottom surface of the head rail as the middle of the first tilt cord is passed over the first guide; and a second tilt cord having a first end, a second end, and a middle of the second tilt cord extending therebetween, the first end of the second tilt cord being coupled to the proximal side of the blind slat through the head rail, the middle of the second tilt cord being positioned on the second guide, and the second end of the second tilt cord extending from the second guide, wherein the proximal side of the blind slat is configured to be at least one of lowered and raised with respect to the bottom surface of the head rail as the middle of the second tilt cord is passed over the second guide.

14. The device of claim 13, wherein the first and second guides are configured to slide along the length of the axle between the front portion and the rear portion as the proximal side of the blind slat is lowered and raised with respect to the bottom surface of the head rail.

15. The device of claim 13, further comprising:

a bottom rail positioned below the blind slat; and a lift cord having a first terminal end, a second terminal end, and a middle portion of the lift cord extending therebetween, the first terminal end being fixedly coupled to the bottom rail, the middle portion of the lift cord being threaded through an opening of the blind slat and a second opening of the head rail, and the second terminal end extending outwardly therefrom, wherein a distance between the bottom rail and the head rail is adjusted by at least one of pulling and releasing the lift cord.

16. The device of claim 15, wherein the first and second tilt cords pass through the second opening.

17. The device of claim 13, wherein the first and second tilt cords are configured to be independently adjustable with respect to the head rail.

18. The device of claim 13, wherein the first and second tilt cords pass through an elongated opening in the head rail.

19. A window covering device, comprising:

a head rail having a top surface, a bottom surface, a front edge, and a rear edge;

a tilt cord support coupled to the head rail and extending between the front edge and the rear edge of the head rail, the tilt cord support having a front portion, a rear portion, and a length extending therebetween;

a blind slat having a distal side and a proximal side, the blind slat being positioned below the bottom surface of the head rail;

a first tilt cord having a first end, a second end, and a middle of the first tilt cord extending therebetween, the first end of the first tilt cord being coupled to the distal side of the blind slat, the middle of the first tilt cord extending through the head rail and being positioned on the tilt cord support, and the second end of the first tilt cord extending from the tilt cord support, wherein the distal side of the blind slat is configured to be at least one of lowered and raised with respect to the bottom surface of the head rail as the middle of the first tilt cord is passed over the tilt cord support; and a second tilt cord having a first end, a second end, and a middle of the second tilt cord extending therebetween, the first end of the second tilt cord being coupled to the proximal side of the blind slat through the head rail, the middle of the second tilt cord being positioned on the second guide, and the second end of the second tilt cord extending from the tilt cord support, wherein the proximal side of the blind slat is configured to be at least one of lowered and raised with respect to the bottom surface of the head rail as the middle of the second tilt cord is passed over the tilt cord support, and wherein the first and second tilt cords are configured to slide between the front portion and the back portion of the tilt cord support as the blind slat is rotated by the first and second tilt cords.

20. The device of claim 19, wherein the first and second tilt cords are configured to be independently adjustable such that one is adjustable with respect to the head rail while a position of the other cord with respect to the head rail is retained.

* * * * *